United States Patent [19]

Hartmann et al.

[11] 4,267,698

[45] May 19, 1981

[54] COOLING-AIR NOZZLE FOR USE IN A HEATED CHAMBER

[75] Inventors: Max Hartmann, Baden; Ferdinand Thuringer, Wettingen, both of Switzerland

[73] Assignee: BBC Brown, Boveri & Co., Ltd., Baden, Switzerland

[21] Appl. No.: 35,265

[22] Filed: May 1, 1979

[30] Foreign Application Priority Data

Jun. 13, 1978 [CH] Switzerland ..... 6413/78

[51] Int. Cl.[3] ..... F02C 7/18

[52] U.S. Cl. ..... 60/756

[58] Field of Search ..... 60/755, 756, 757, 266

[56] References Cited

U.S. PATENT DOCUMENTS 2,477,583 8/1949 De Zubay et al. ..... 60/757

3,995,422 12/1976 Stamm ..... 60/757

FOREIGN PATENT DOCUMENTS 665155 1/1952 United Kingdom ..... 60/757

*Primary Examiner*—Robert E. Garrett

*Attorney, Agent, or Firm*—Burns, Doane, Swecker & Mathis

[57] ABSTRACT

To obtain uniform cooling of the wall (1) of a combustion chamber of a gas turbine, it is proposed to provide ridges (2) in the wall (1), with cooling-air nozzles (3) being inserted into the ridges. The cooling-air nozzles (3) thus do not project into the main gas stream and the cooling film can be guided in a rheologically favorable manner between the surface (11) which is to be cooled and the main gas stream.

7 Claims, 5 Drawing Figures

Fig. 3
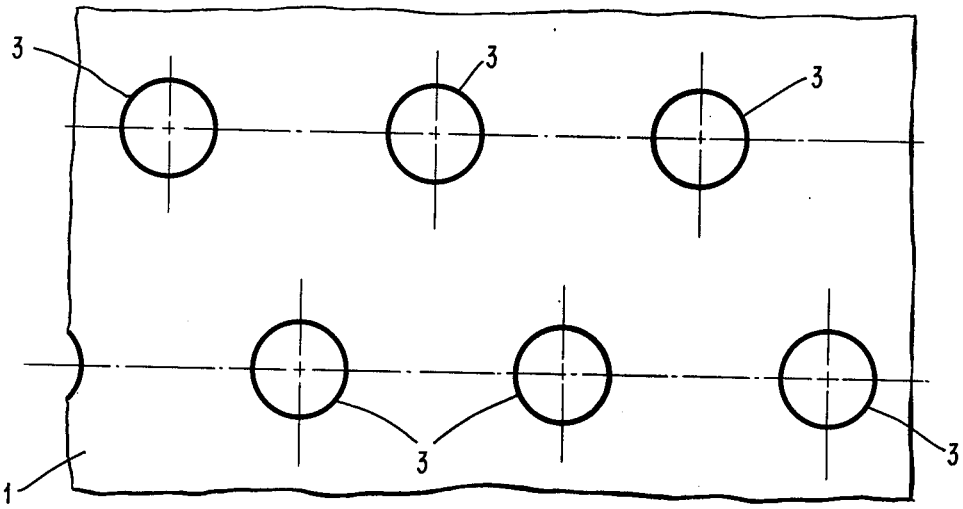
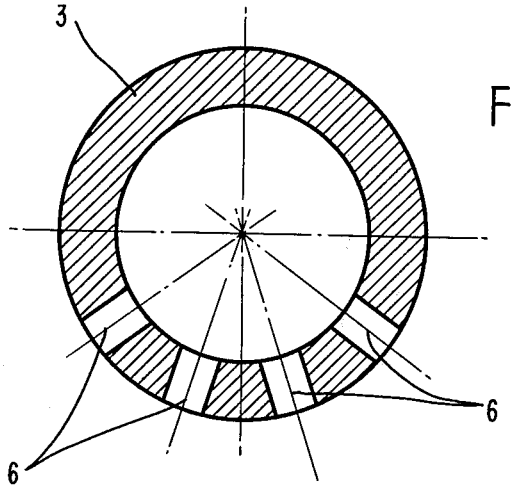
Fig. 4
Fig. 5
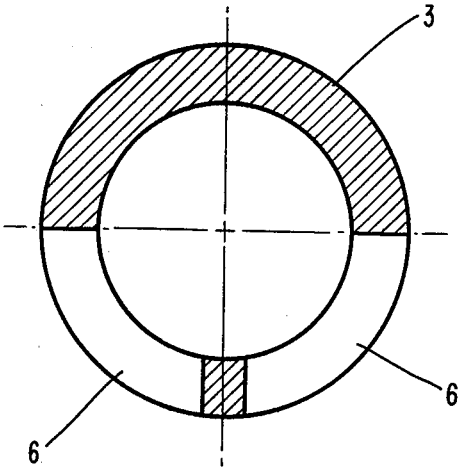

COOLING-AIR NOZZLE FOR USE IN A HEATED CHAMBER

BACKGROUND AND OBJECTS OF THE INVENTION

The present invention relates to a cooling-air nozzle which comprises essentially a nozzle body with inlet and outlet orifices for the film-cooling of heated surfaces, in particular for use with flame tubes in the combustion chambers of gas turbines.

As the hot gas temperatures in the combustion chambers of gas turbines rise, convective cooling of the flame tubes becomes increasingly more difficult. To obtain uniform cooling of the flame tube, it is necessary to provide film-cooling wherein a film of cooling air flows along the wall of the flame tube on the side of the flame or the hot gas, which film of cooling air prevents the hot gases from coming into direct contact with the wall. The wall temperatures can effectively be lowered in this way.

Among the various proposals which have already been made for carrying out the film-cooling of flame tubes are, for example, the provision of orifices bored directly into the wall, or the provision of apertured rings inserted into the wall of the flame tube (see page 52 of Sawyer's Gas Turbine Catalog, 1976).

These known solutions involve, however, the disadvantages that the resulting film of cooling air is interrupted and that heat stresses arise in the ring portions due to an uneven temperature distribution. Moreover, the provision of orifices or apertured rings in the shell of the flame tube can lead to burbles in the flow of hot gas.

It is, therefore, an object of the present invention to minimize or obviate problems of the type discussed above.

It is another object of the present invention to provide a cooling-air nozzle in which the known disadvantages do not arise and in which the film of cooling air achieves a uniform surface cooling of the wall of the flame tube.

BRIEF SUMMARY OF THE INVENTION

According to the present invention, the abovementioned objects are achieved by locating cooling-air nozzles flush with the surface which is to be cooled, and within ridges of the wall of the combustion chamber.

The positioning of cooling-air nozzles within ridges of the wall results in the advantage that the nozzles do not project into the main gas stream. Thus, the cooling film can be guided in a rheologically favorable manner between the wall which is to be cooled and the main gas stream.

It is also preferable to arrange the individual nozzles uniformly around the periphery of the wall which is to be cooled.

According to a further preferred embodiment, the individual nozzles can be arranged mutually offset, in the outflow direction, in several planes. This results in the further advantage that a greater length of the wall can be cooled.

In the design of the individual nozzles, it can be appropriate to arrange the outlet orifice radially over a part of the periphery of the nozzle body or to form the outlet orifice by radial bores in adjacent positions, or to subdivide the outlet orifice by webs.

These different shapes of the nozzle outlet orifice make it possible to adapt the stream of cooling air to the particular requirements or to distribute the cooling film in the manner of a fan, or to permit a slight intersecting of the individual part streams so that an uninterrupted cooling film is formed.

According to a further preferred embodiment, an orifice plate is provided at the inlet to the nozzle body for regulating the amount of cooling air.

BRIEF DESCRIPTION OF THE DRAWING

An illustrative embodiment of the subject of the invention is represented in a simplified manner in the drawing in which:

FIG. 2 shows a view of two cooling-air nozzles arranged in circumferentially adjacent positions.

FIG. 3 is a partial side view of a wall with cooling nozzles arranged in different planes in staggered relation;

FIG. 4 is a cross-sectional view through a nozzle of the type having a series of radial discharge bores; and FIG. 5 is a cross-sectional view through a nozzle of the type having an arc-shaped discharge orifice subdivided by a web.

DETAILED DESCRIPTION OF A PREFERRED EMBODIMENT OF THE INVENTION

Figure 1:
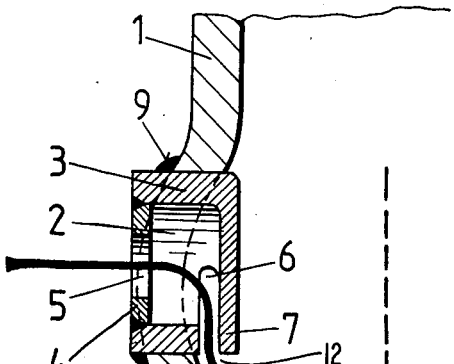
FIG. 1 shows a longitudinal section through a part of a wall, with a cooling-air nozzle inserted.

According to FIG. 1, numeral 1 designates a cylindrical wall, for example the wall of the flame tube of a combustion chamber. The wall has around its periphery an outwardly projecting ridge 2 defining a depression 12 within internal surface 11 of the combustion chamber into which a circumferential row of cooling-air nozzles 3 are mounted. The depth dimension of the ridge 2 in the radial direction of the combustion chamber is such that the cooling-air nozzles 3 do not project into the main gas stream indicated by a broken arrow, but rather are flush, i.e., coplanar with the surface 11 along which the flow passes.

On the air inflow side, each cooling-air nozzle 3 includes an orifice plate 4, by means of which the flow of cooling air can be regulated. The orifice plate 4 can have an orifice 5 with a fixed setting or it can also be provided with an adjustable orifice so that the flow of cooling-air can be infinitely controlled.

On the air discharge side, projecting into the wall 1, the cooling-air nozzle 3 is provided with a discharge outlet orifice 6 which extends radially relative to the cylindrically shaped nozzle. The discharge orifice 6 is shielded from the main gas stream by a baffle plate 7 so that the stream 8 of cooling air flow longitudinally along the surface 11 and forms there a film of cooling air. The cooling-air nozzles 3 can be fixed in the wall 1 either by a weld seam 9 or by screw threads or a snap fitting.

In FIG. 2, the same parts are given the same reference numerals as in FIG. 1. A stream 8 of cooling air passes through each of the outlet orifices 6 of the cooling-air nozzles 3. The cooling-air nozzles 3 are mutually arranged in such a way, or the outlet orifices 6 are shaped in such a way, that the individual streams 8 of cooling air are distributed in the manner of a fan and are combined to give an uninterrupted film 10 of cooling air.

If it is necessary to cool the wall 1 over a greater length, one or more rows of cooling-air nozzles 3 can be arranged in circumferentially offset relationship in several planes one above the other (FIG. 3).

The discharge orifice 6 of each nozzle may comprise a single arc-shaped opening, or may be subdivided by webs, or may comprise a series of radial bores (FIG. 5).

As a result of arranging the cooling-air nozzles 3 in accordance with the invention, stresses in the edges of the holes and the notch effect are largely avoided due to the reinforcing action of the cooling-air nozzles 3 inserted into the wall 1. Furthermore, the axial temperature gradient in the wall 1 is reduced at the points where cooling air is fed in, since the full thermal effect of the cooling film does not suddenly arise on a continuous circumferential line but is reached only gradually.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A cooling-air nozzle in combination with a heated chamber of the type comprising an enclosure wall having an internal surface to be cooled, said nozzle including a nozzle body having cooling air inlet means, and cooling air discharge means directed generally longitudinally relative to said wall, said internal surface including a depression, said nozzle body being located within said depression such that the innermost end thereof is substantially flush with said internal surface.

2. Apparatus according to claim 1 comprising a plurality of said cooling-air nozzles arranged uniformly in a circumferential row around the periphery of said internal surface.

3. Apparatus according to claim 1 comprising a plurality of longitudinally spaced circumferential rows of said nozzles, the nozzles of one row being circumferentially offset relative to the nozzles of another row.

4. Apparatus according to claim 1, wherein said nozzle body is of generally cylindrical configuration, said air discharge means being radially oriented relative to said nozzle body.

5. Apparatus according to claim 4, wherein said air discharge means of each nozzle is subdivided by webs.

6. Apparatus according to claim 1, wherein said nozzle body is of generally cylindrical configuration, said discharge means comprising bores extending radially relative to said nozzle body.

7. Apparatus according to claim 1, wherein said nozzle body includes an orifice plate carrying said air inlet means for regulating the amount of cooling air.

* * * * *